United States Patent [19]

Mooz

[11] Patent Number: 4,622,443

[45] Date of Patent: Nov. 11, 1986

[54] SINGLE-POLE LOAD DISCONNECTING SWITCH ARRANGEMENT IN A HOUSING

[75] Inventor: Dietrich Mooz, Krefeld, Fed. Rep. of Germany

[73] Assignee: Felten & Guilleaume Energietechnik GmbH, Cologne, Fed. Rep. of Germany

[21] Appl. No.: 631,940

[22] Filed: Jul. 12, 1984

[51] Int. Cl.[4] ..... H01H 9/00; H01H 31/00

[52] U.S. Cl. ..... 200/50 R; 200/48 KB; 200/153 SC; 361/334

[58] Field of Search ..... 200/48 R, 48 KB, 48 SB, 200/48 V, 48 CB, 48 A, 48 P, 293, 50 A, 50 C, 146 R, 146 A, 153 SC; 361/344, 334, 332

[56] References Cited

U.S. PATENT DOCUMENTS

| | | | |
|---|---|---|---|
| 2,363,364 | 11/1944 | Rugg | 361/344 |
| 2,785,254 | 3/1957 | Atkinson | 200/146 R |
| 2,954,450 | 9/1960 | Mikos | 200/48 R X |
| 3,875,360 | 4/1975 | Rys | 200/50 A X |

FOREIGN PATENT DOCUMENTS

| | | |
|---|---|---|
| 1165711 | 1/1966 | Fed. Rep. of Germany . |
| 7338407 | 10/1973 | Fed. Rep. of Germany . |
| 2850761 | 12/1981 | Fed. Rep. of Germany . |
| 3044327 | 1/1984 | Fed. Rep. of Germany . |

*Primary Examiner*—J. R. Scott

*Attorney, Agent, or Firm*—Michael J. Striker

[57] ABSTRACT

An arrangement for mounting single-pole load-disconnecting switches in a middle voltage net includes a plurality of conventional, individually switchable load-disconnecting switches mounted on a single common base frame enclosed with a common housing. All the switches are arranged on individually rotatable hubs positioned on a common central shaft journalled in the base frame. Each hub establishes the connection between the associated load-connecting switch and a respective drive. Each switch is additionally provided with a support which carries a high voltage-high efficiency safety device.

2 Claims, 5 Drawing Figures

SINGLE-POLE LOAD DISCONNECTING SWITCH ARRANGEMENT IN A HOUSING

BACKGROUND OF THE INVENTION

The present invention relates to an arrangement of single-pole switches in a middle voltage network.

Single-pole switches are customary in middle voltage networks utilized in the USA. A switch safety device is utilized as a single-pole switch element which is defined in the United States as a "Powerfuse". Such a switch safety device is usually combined with an extinguishing device for normal load currents. The switch element must be actuated by means of a switch rod, for which corresponding safety precautions, such as a safety tightening or protective screen, are required.

SUMMARY OF THE INVENTION

It is an object of the present invention to provide a reliable and safe operation of single-pole conventional load-disconnecting switches.

It is another object of the present invention to provide an improved arrangement of single-pole load-disconnecting switches in a middle voltage network.

The objects of the invention are attained by the provision of a number of single-pole, conventional load-disconnecting switches which are individually switchable-over by means of individual suitable drives. Each individual switch is provided in the known fashion with a high voltage-high efficiency safety device arranged behind the associated switch.

The chief advantage of the present invention resides in that the safety of single-pole disconnectors is substantially enhanced as compared to those known in the art.

The above mentioned objects of the present invention are attained in particular by an arrangement for mounting single-pole load-disconnecting switches in a middle voltage network, comprising a plurality of single-pole load-disconnecting switches, a common base frame, an elongated shaft positioned in said frame and including a plurality of hubs slidably positioned thereon, each switch having an individual drive, each of said hubs connecting an associated switch with a respective individual drive, each switch including a mounting support and a high voltage-high efficiency safety device connected to said support.

The arrangement may further include a housing accommodating said frame, said shaft and said switches, and at least one door for closing said housing.

The hubs may be rotatable on said shaft independently from each other.

Each individual drive may include a first lever rigidly connected to an associated hub, a connecting rod connected to said first lever and having a free end, a second lever also rigidly connected to said hub, a switching-on spring connected to the free end of said connecting rod, and a switching-off spring connected to said second lever.

Each individual drive may include a compression spring, an actuated elongated connecting rod having a free end engaged with said compression spring, and a lever rigidly connected to the associated hub and pivotally connected to said connecting rod.

Each of the switches includes in the known fashion a current-conducting member; compling rods for connecting the associated hub to the respective current-conducting member may be provided in this arrangement.

The frame may be formed with an abutment, said abutment being provided with a plurality of insertion openings for actuating said individual drives, from outside of said housing, the number of said openings corresponding to the number of said switches, said door being formed with a recess to provide for an access to said insertion openings.

The high voltage-high efficiency safety device includes a release mechanism which switches off an associated load-disconnecting switch by means of release pulses.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
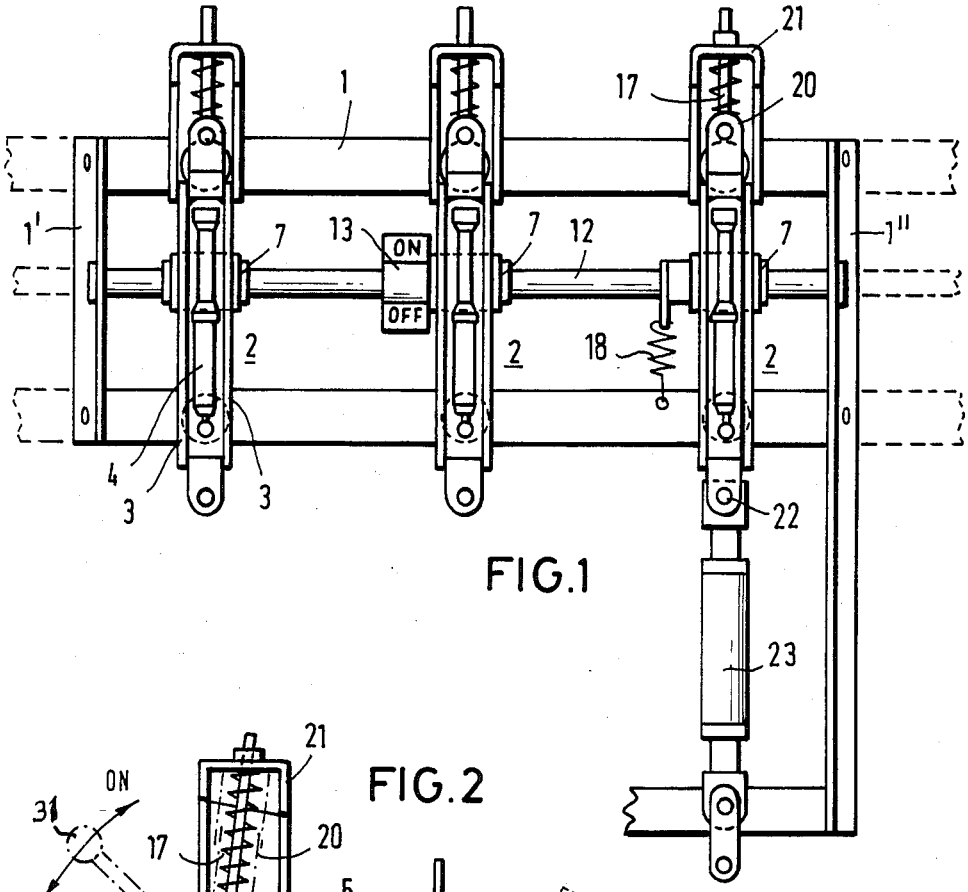
FIG. 1 is a schematic front view of the arrangement according to the invention, which includes three load-disconnecting switches arranged on a common mount frame.

Referring now to the drawings in detail, the arrangement of single-pole load-disconnecting switches includes a plurality of switches generally denoted by 2, which are mounted on a common mounting frame 1. Three load-disconnecting switches or circuit breakers 2 are shown in FIG. 1, which are spaced from each other along the mounting frame or base 1 and each includes a current-conducting member 3 provided with a quenching device 4. The conventional current-conducting member 3 and the quenching device 4 are arranged on supporting elements 5 attached to the back side of the mounting frame 1. Such a single pole load-disconnecting switch has been known, for example from German patent publications DE-GM 73 38 407.3 and DE-PS 11 65 711. The operation of such a single-pole load-disconnecting switch has been described in the latter German disclosure.

The mounting frame 1 is provided with shaft-receiving walls 1' and 1'' positioned opposite to each other and having bearings which receive the respective ends of a shaft 12. In the exemplified embodiment, shaft 12 carries three hubs 7 spaced from each other along the length of the shaft 12. Hubs 7 are slidably adjustable on shaft 12. Hubs 7 serve the purpose of connecting the current-conducting elements 3 of respective load-disconnecting switches 2 with the respective drives. The hubs 7 of all individual switches 2 are rotatable on shaft 12 independently from each other.

Figure 2:
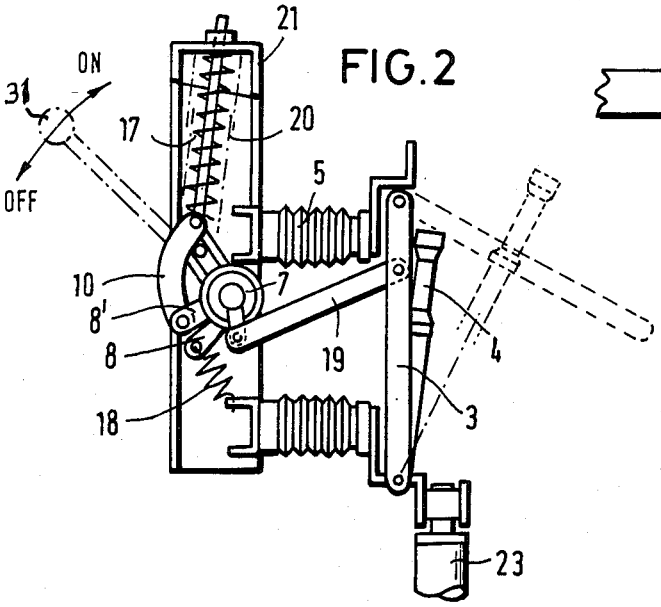
FIG. 2 is a schematic side view of the individual switch provided with a storage drive.

The drive of the individual load-disconnecting switch 2 is shown in FIG. 1 at the right-hand side thereof and in FIG. 2 in greater detail. The storage drive includes a switch-on spring 17 and a switch-off spring 18 provided for independent and quick switching and a quick release, upon a release command, of each switch 2. Switch-on spring 17 and switch-off spring 18 are prestressed one after another during the disconnecting movement or connecting movement shown by arrows in FIG. 2 and caused by rotating a lever 31 shown by a dotted line, and ensure a quick switch-on and quick switch-off of the circuit.

Two parallel coupling rods 19 are interconnected between the respective hub 7 and the current-conducting member 3. The end of each coupling rod 19, remote from hub 7, is pivotally connected to the respective wall of the current-conducting member 3 of each switch. Current-connecting member 3 is also connected by the lower supporting element 5 to spring 18. The fashion of the operation of the storage drive is as follows:

The load-disconnecting switch illustrated in FIG. 2 is shown in a switch-off position. When the current-conducting member 3 opens switch-off spring 18 and switch-on spring 17 are in a relaxed position. The switching-on of the switch occurs when first the switch-on spring 17 is brought to a tensioned position. In this pretensioned position spring 17 is held with its greatest force whereby this spring holds itself behind the dead point. During the passing of the dead point the spring 17 is coupled with the respective hub 7. If the switch-on spring 17 is retained over the dead point this spring is contracted and the drive is actuated in a striking fashion, as has been disclosed in the above mentioned German patent applications. Spring 18 is simultaneously tensioned and load-disconnecting switch 2 is switched on. Upon switching off the switch 2, hub 7 is released and the spring 18 rotates hub 7 so that current-conducting member 3, connected to hub 7 by parallel coupling rods 19, is again brought into a switch-off position. The connection between the hub 7 and switch-off spring 18 is carried out by a lever 8. Another lever 8', which is interconnected between hub 7 and a connecting member 10, produces the connection between hub 7 and switch-on spring 17. The switch-on spring 17 is accommodated in a supporting tube 20 which in turn is positioned within a bearing element 21.

The right-hand load-disconnecting switch 2, as shown in FIG. 1, is provided with a holding member 22 which holds a conventional high voltage-high efficiency safety device 23. A position indicator 13 is mounted to the hub 7 of the intermediate switch 2. Position indicator 13 has marks "on" and "off" and indicates the corresponding on and off positions of the switch.

Figure 3:
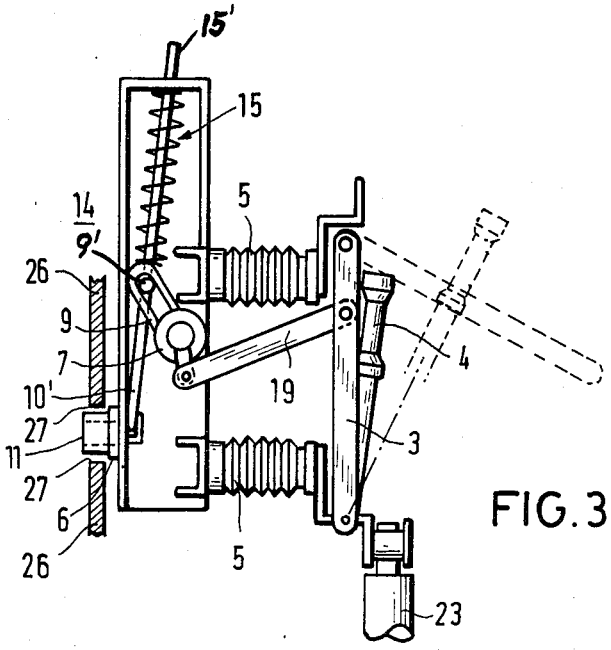
FIG. 3 is a schematic side view of the individual switch provided with a spring drive.

In the embodiment illustrated in FIG. 3, a spring drive generally designated by reference numeral 14 is provided. Reference numeral 27 designates a recess in the door 26, which recess is necessary to release the drive of the load-disconnecting switch 2. The left-hand and intermediate switches of FIG. 1 are each equipped with such a spring drive. The spring drive is the drive of FIG. 3 which immediately cooperates with hub 7 and ensures that the switch 2 is switched on independently from the conditions and always with the same and sufficient speed.

With the aid of the loaded energy storage device, which is comprised of a compression spring 15 mounted on an elongated pin 15', a sudden switching-on of switch 2 results. Hub 7 is rigidly connected to a U-shaped lever 9 which is pivotable on a pin 9' connected to the elongated pin 15' supporting the compression spring 15 as shown in FIG. 3. A connecting rod 10' secured to pin 9' is engaged in a recess formed in an abutment 6 provided on the mounting frame 1. The end of connecting rod 10' is accessible from outside through an insertion opening 11 made in abutment 6. Such an insertion opening is formed for each switch to actuate the latter from outside. During the switching-off of switch 2 hub 7 of the respective switch performs the movement within an actuating angle which is comprised of a free-running angle and a spring angle. In this case a middle vertical through hub 7 is above and dead point position of the compression spring, and the free-wheeling or free-running movement results towards that middle vertical, and from that time forward a spring movement of hub 7 takes place.

During the switching-on of switch 2 the operation of spring drive 14 of FIG. 3 takes place in the same sequence but in the reversed direction. A non-illustrated actuating lever is inserted into the insertion opening 11 of abutment 6 to effect the connecting rod 10' and to prestress the compression spring 15.

Figure 4:
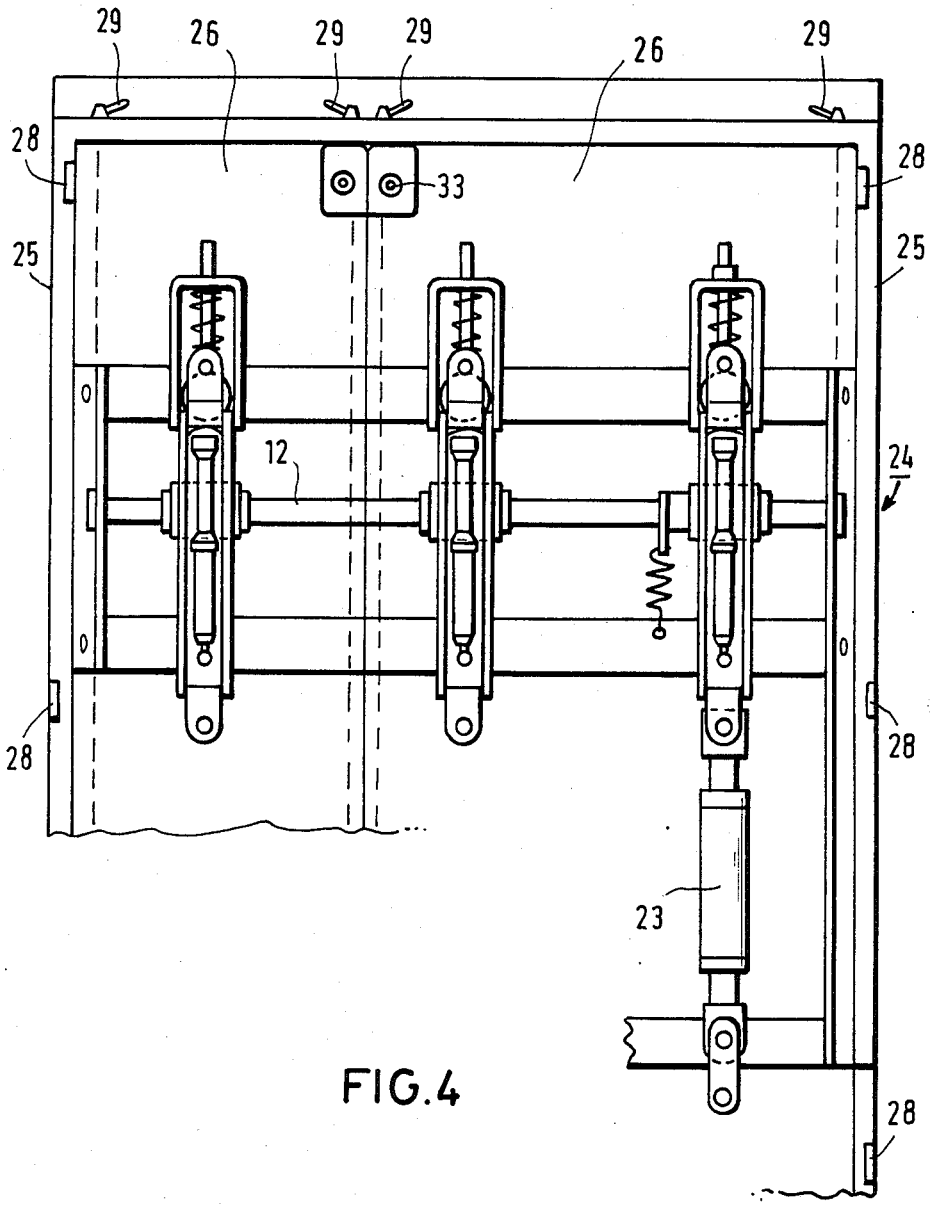
FIG. 4 is a schematic front view of three load-disconnecting switches accommodated in one housing.

FIG. 4 shows a housing 24, in which mounting frame 1 and shaft 12 carrying three load-disconnecting switches are accommodated. Housing 24 has two doors 26. Both doors are hinged on side walls 25 by means of hinges 28. Doors 26 are additionally locked by torsion locks 29 which prevent gases from flowing towards the front side in the event of explosive pressure within the housing. Both doors 26 can be locked by a turnbuckle 33.

Figure 5:
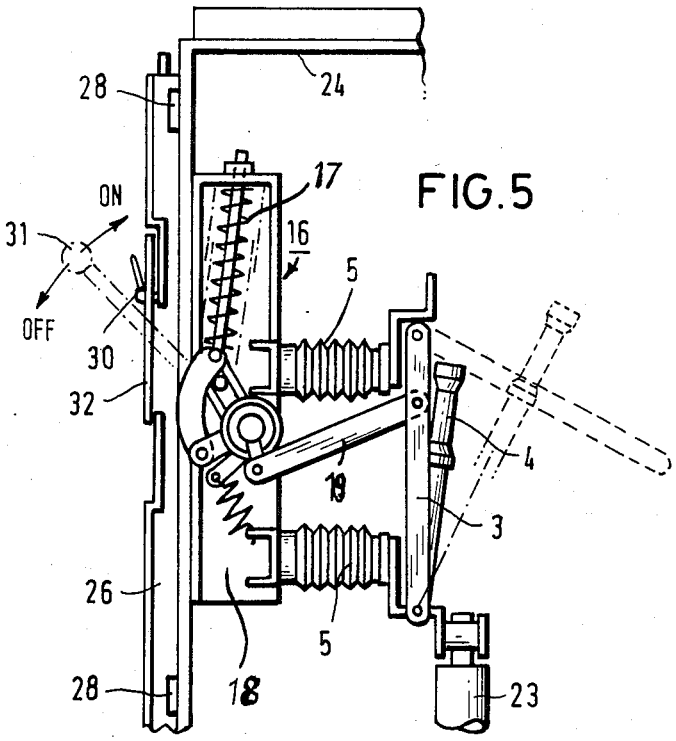
FIG. 5 is a side partial view of the housing with the switches of FIG. 4.

FIG. 5 shows a portion of housing 24 with the storage drive 16. A window (not shown) closable by a plate 32 may be provided in the door 26. A torsion lock 30 is provided on plate 32 to lock the latter. A corresponding recess also not shown for lever 31 is normally made in plate 32. The construction of the storage drive shown in FIG. 5 corresponds to that depicted in FIG. 2. A corresponding recess is formed in at least one of doors 26 to provide an access to insertion openings 11 for actuating connecting rods 10' and springs 15.

The high voltage-high efficiency safety device 23 is a conventional device which is known as H.R.C. (High-Rupture Capacity) for a single interruption of short-circuit currents in indoor and outdoor switch devices. These safety arrangements are suitable as protection against short circuits in voltage transducers, condensors, cable dividers, transformers and similar installations. These safety devices also protect switches and leads against thermal and dynamic effects of intensive short-circuit currents before those effects break the current-limiting safety arrangements. A fusible conductor, which fuses and evaporates, is normally installed in the safety device. It includes an arc lamp which is cooled by a surrounding sand. At the moment of breaking down of a fusible conductor a current value will strongly decrease; however in alternating current circuits current in the case of overloads will be first interrupted in a following zero passage.

It will be understood that each of the elements described above, or two or more together, may also find a useful application in other types of arrangements of single-pole circuit breakers in middle voltage networks differing from the types described above.

While the invention has been illustrated and described as embodied in an arrangement of single-pole load-disconnecting switches in a middle voltage network, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for mounting single-pole load-disconnecting switches in a middle voltage network, comprising a plurality of single-pole load-disconnecting switches; a common base frame, a common elongated shaft positioned in said frame; a plurality of hubs positioned on said shaft and spaced from each other along said shaft, said hubs being each movable along said shaft so that the position of each hub on said shaft is adjusted, each switch being supported in said frame and having an independent drive operated for actuating said switch so that each single-pole switch can be actuated independently from the other switch, each of said hubs connecting an associated switch with the respective independent drive, each of said switches including a mounting support for accommodating the associated drive; a housing accommodating said frame, said shaft and said switches; at least one door for closing said housing, each switch including a movable contact member; and coupling means provided to connect each hub to the associated movable contact member of the respective switch, and wherein each independent drive includes a first lever rigidly connected to an associated hub, a connecting member connected to said first lever and having a free end, a second lever also rigidly connected to said hub, a switching-on spring rigidly connected to the free end of said connecting member, and a switching-off spring connected to said second lever, whereby said switching-on and switching-off springs cooperate with the associated hub to switch on and off the associated switch.

2. The arrangement as defined in claim 1, wherein each movable contact member is a contact blade; said coupling means including coupling rods connecting the associated hub to the respective contact blade.

* * * * *